US009757597B2

(12) United States Patent
Kotrla et al.

(10) Patent No.: US 9,757,597 B2
(45) Date of Patent: Sep. 12, 2017

(54) SAFETY-HARNESS ATTACHMENT

(75) Inventors: Johnnie Kotrla, Katy, TX (US); Gary R. Driver, Katy, TX (US); Carter Erwin, Montgomery, TX (US)

(73) Assignee: Cameron International Corporation, Houston, TX (US)

( * ) Notice: Subject to any disclaimer, the term of this patent is extended or adjusted under 35 U.S.C. 154(b) by 1057 days.

(21) Appl. No.: 13/256,615

(22) PCT Filed: Apr. 29, 2010

(86) PCT No.: PCT/US2010/033031

§ 371 (c)(1),
(2), (4) Date: Sep. 14, 2011

(87) PCT Pub. No.: WO2010/127157

PCT Pub. Date: Nov. 4, 2010

(65) Prior Publication Data

US 2012/0032042 A1 Feb. 9, 2012

Related U.S. Application Data

(60) Provisional application No. 61/174,851, filed on May 1, 2009.

(51) Int. Cl.

| | |
|---|---|
| ***A47B 97/00*** | (2006.01) |
| ***A62B 35/00*** | (2006.01) |
| ***E04G 21/32*** | (2006.01) |
| ***E21B 41/00*** | (2006.01) |

(52) U.S. Cl.

CPC ..... *A62B 35/0068* (2013.01); *E04G 21/3261* (2013.01); *E21B 41/0021* (2013.01)

(58) Field of Classification Search

CPC ..... A62B 35/0068; E04G 21/3261; E21B 41/0021

USPC .... 248/499, 500, 505, 910, 49, 175; 52/687, 52/688, 689

See application file for complete search history.

(56) References Cited

U.S. PATENT DOCUMENTS

| | | | | |
|---|---|---|---|---|
| 1,410,633 | A * | 3/1922 | White | 52/688 |
| 1,541,302 | A * | 6/1925 | White | 52/689 |
| 2,349,399 | A * | 5/1944 | Awbrey | 52/686 |
| 2,798,393 | A * | 7/1957 | Currin | 81/176.1 |
| 3,693,310 | A * | 9/1972 | Middleton | 52/685 |
| 4,689,867 | A * | 9/1987 | Tolliver | 29/453 |
| 4,932,185 | A | 6/1990 | Lebel | |
| 5,035,391 | A * | 7/1991 | Steele et al. | 248/346.03 |
| 5,813,486 | A | 9/1998 | Smith et al. | |
| D401,255 | S * | 11/1998 | Burns | D21/453 |
| 6,206,613 | B1 * | 3/2001 | Elkins | 405/157 |
| 2003/0015372 | A1 | 1/2003 | Herrmann | |

FOREIGN PATENT DOCUMENTS

| | | |
|---|---|---|
| FR | 2166691 | 8/1973 |

OTHER PUBLICATIONS

PCT/US2010/033031 Search Report and Written Opinion dated Jul. 6, 2010.

* cited by examiner

*Primary Examiner* — Gwendolyn Baxter
(74) *Attorney, Agent, or Firm* — Fletcher Yoder, P.C.

(57) ABSTRACT

A safety-harness attachment for attaching a safety harness thereto.

24 Claims, 2 Drawing Sheets

SAFETY-HARNESS ATTACHMENT

CROSS REFERENCE TO RELATED APPLICATIONS

This application claims priority to and benefit of PCT Patent Application No. PCT/US2010/033031, entitled "Safety-Harness Attachment", filed on Apr. 29, 2010, which is herein incorporated by reference in its entirety, and which claims priority to and benefit of U.S. Provisional Patent Application No. 61/174,851, entitled "Safety-Harness Attachment", filed on May 1, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, supplies of oil and natural gas have a profound effect on modern economies and civilizations. Devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource.

Equipment to extract such resources can, in certain instance, be large in size. To fabricate and repair extraction equipment, it may be beneficial for appropriate personnel to perform activities on the equipment itself. However, this may place the personnel at relatively high locations on the equipment. Under certain workplace requirements, safety harness and restraints may by required for personnel working a given distance above the floor the equipment is on.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
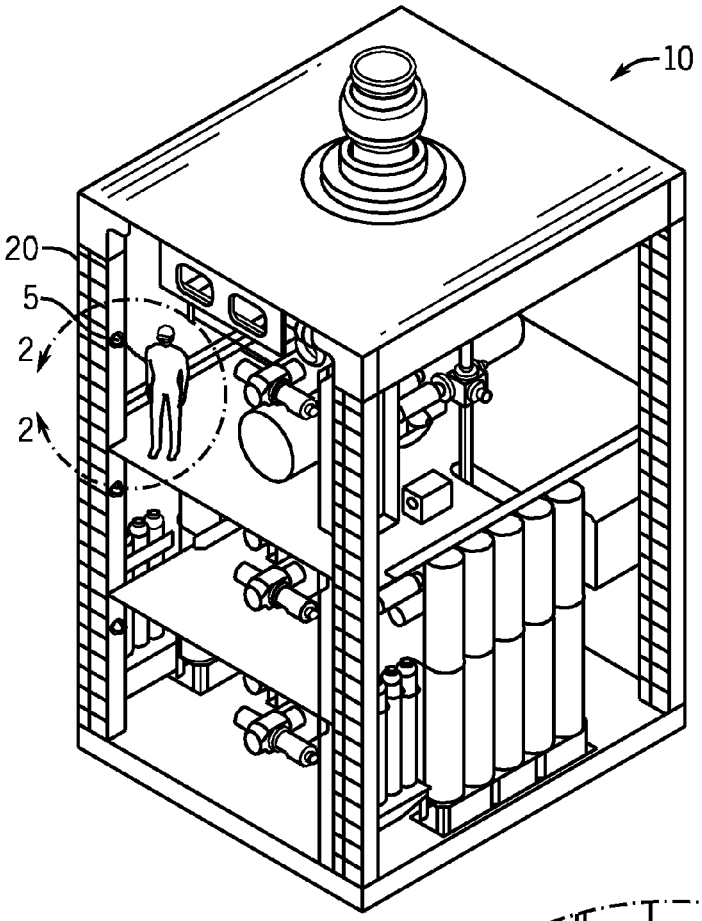
FIG. 1 is a perspective illustration of oilfield equipment, in accordance with one embodiment of the present technique.

FIG. 1 illustrates an exemplary piece of equipment on which a safety-harness attachment 5 is provided. Specifically, the equipment shown is a subsea BOP (blowout-preventer) stack 10. However, the exemplary safety-harness attachment is applicable to any piece of equipment that could benefit with a feature to which a harness could be secured, whether that equipment is for the oilfield (e.g., a BOP, a Christmas tree, a valve assembly, a compressor, a manifold, a production assembly, among others) or other industrial equipment.

Figure 2:
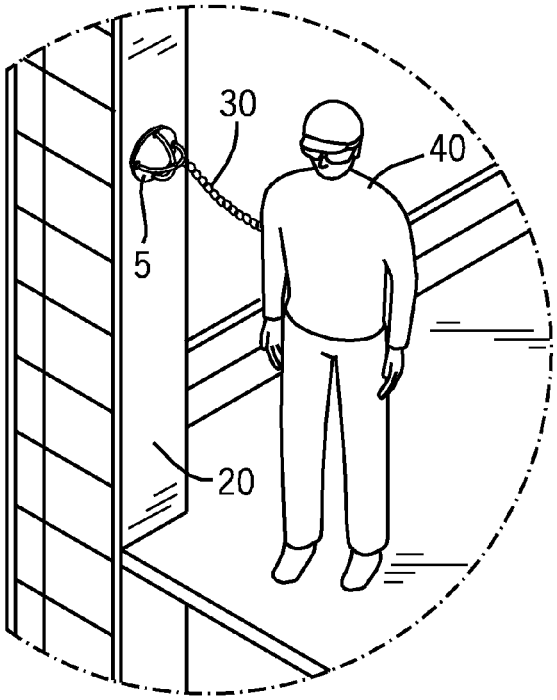
FIG. 2 is a detail of the equipment of FIG. 1.
Figure 3:
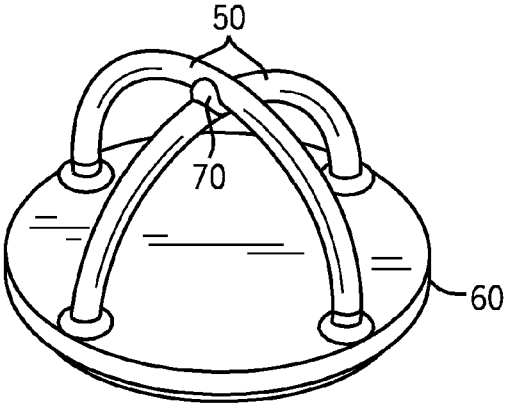
FIG. 3 is a perspective illustration of a safety-harness attachment, in accordance with one embodiment of the present technique.
Figure 4:
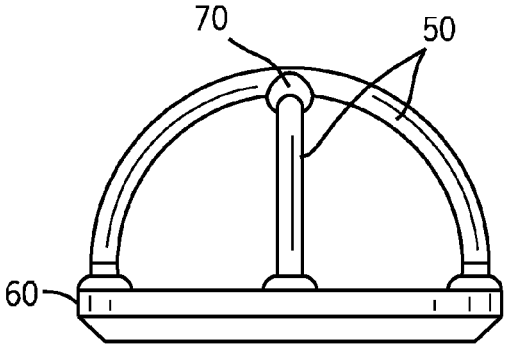
FIGS. 4 and 5 are side views of the safety-harness attachment of FIG. 3.
Figure 5:
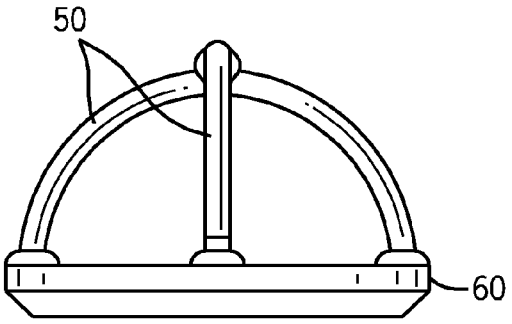
Figure 6:
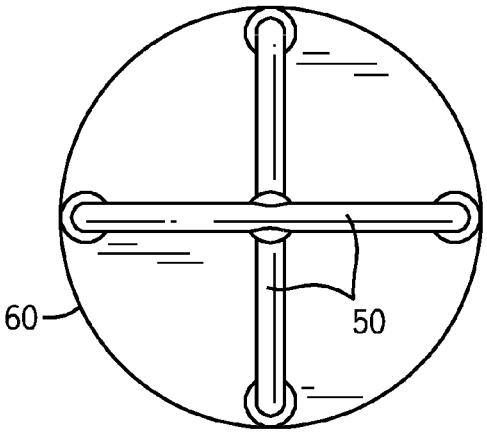
FIG. 6 is a top view of the safety-harness attachment of FIG. 3.

As illustrated in FIG. 2, the safety-harness attachment 5 may be mounted on a structural member 20 of the equipment 10. By way of example, the safety-harness attachment 5 may be welded onto the structural member 20, or secured using fastener, among other suitable techniques. The safety-harness attachment 5 may be mounted onto virtually any surface of the equipment 10, whether that surface is flat or curved, or vertical, horizontal or angular to the ground the equipment 10 is placed on. Moreover, the safety harness attachment 5 may be provided as an integral part of the equipment 5 or may be retrofitted onto existing equipment.

The safety-harness attachment 5 provides a dedicated feature to which a safety harness 30 may be attached, rather than being attached to an operating component of the equipment 10 that has a different purpose and may be damaged by misuse.

The illustrated safety harness 30 is a flexible device that provides freedom of movement to the technician 40, but mitigates against the technician from falling off of the equipment 10 by coupling the technician 40 to the equipment 10. The safety harness 30 may include various latching mechanisms to secure to the technician 40 and the safety harness attachment 5, respectively.

FIGS. 3-6 illustrate an exemplary safety-harness attachment 5. The illustrated safety-harness attachment includes two latch members 50 secured to a base 60. Although illustrated with two latch members 50, a safety-harness attachment 5 with any number of latch members 50 is envisaged. Moreover, the latch members 50 may be arcuate in shape, or angular, or a combination thereof.

The illustrated latch members 50 are attached to one another at a joint 70. The joint 70 provides added integrity to the safety-harness attachment 5, and also segregates the latch members 50 in four regions, to facilitate the attachment of multiple safety harnesses to a single safety-harness attachment 5.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An assembly, comprising:

a safety-harness attachment, comprising:

a base portion; and a first latching portion having a first end and a second end attached to the base portion;

wherein the safety-harness attachment is coupled to an oilfield device.

2. The assembly of claim 1, wherein the base portion comprises a circular plate.

3. The assembly of claim 2, wherein the first end of the first latching portion and the second end of the first latching portion are attached to the circular plate near an outer circumference of the circular plate.

4. The assembly of claim 3, wherein the first latching portion comprises a first half-circular arc that extends directly to both the first end and the second end, the safety-harness attachment comprises a second latching portion having a second half-circular arc that extends directly to both a third end and a fourth end attached to the circular plate near the outer circumference of the circular plate, the first and second half-circular arcs cross one another at an offset distance from the circular plate, wherein the first, second, third, and fourth ends are fixed to the circular plate.

5. The assembly of claim 1, wherein the safety-harness attachment comprises a second latching portion having a third end and a fourth end attached to the base portion.

6. The assembly of claim 5, wherein the first latching portion is attached to the second latching portion at a joint not on the base portion.

7. The assembly of claim 1, wherein the oilfield device comprises a blowout-preventer (BOP).

8. The assembly of claim 7, wherein the BOP is a subsea BOP.

9. The assembly of claim 1, wherein the oilfield device is a Christmas tree.

10. The assembly of claim 1, wherein the safety-harness attachment is dedicated only for attaching a safety harness thereto.

11. A safety-harness attachment comprising:

a base portion, wherein the base portion comprises a circular plate;

a first curved latching portion that generally curves between a first end and a second end, wherein the first curved latching portion terminates and fixedly couples to the base portion at the first and second ends; and a second curved latching portion that generally curves between a third end and a fourth end, wherein the second curved latching portion terminates and fixedly couples to the base portion at the third and fourth ends.

12. The safety-harness attachment of claim 11, wherein the first and second ends of the first curved latching portion and the third and fourth ends of the second curved latching portion are fixed to the circular plate near an outer circumference of the circular plate.

13. The safety-harness attachment of claim 11, wherein the first curved latching portion comprises a first half-circular arc that extends directly to both the first end and the second end, and the second curved latching portion comprises a second half-circular arc that extends directly to both the third end and the fourth end.

14. A safety-harness attachment comprising:

a base portion;

a first curved latching portion that generally curves between a first end and a second end, wherein the first curved latching portion terminates and fixedly couples to the base portion at the first and second ends; and a second curved latching portion that generally curves between a third end and a fourth end, wherein the second curved latching portion terminates and fixedly couples to the base portion at the third and fourth ends, wherein the first curved latching portion and the second curved latching portion cross one another at an offset distance from the base portion.

15. The safety-harness attachment of claim 14, wherein the first curved latching portion is fixed to the second curved latching portion at a joint not on the base portion.

16. A system, comprising:

an equipment; and a safety-harness attachment, comprising:

a base fixed to the equipment, and a first latching member extending between a first end and a second end; and a second latching member extending between a third end and a fourth end, wherein the first and second latching members cross one another at an offset distance from the base, wherein the first, second, third, and fourth ends are fixed to the base.

17. The system of claim 16, wherein the first and second latching members intersect and fixedly couple to one another at a joint at the offset distance from the circular base.

18. The system of claim 17, wherein the first and second latching members comprise first and second half-circular arcs that intersect and fixedly couple to one another at the offset distance from the base, wherein the first half-circular arc extends directly to both the first and second ends, wherein the second half-circular arc extends directly to both the third and fourth ends, wherein the joint is generally located at first and second apexes of the first and second half-circular arcs.

19. The system of claim 18, wherein the equipment comprises an oilfield device.

20. The system of claim 16, wherein the base comprises a circular base having an outer circumference, wherein the first, second, third, and fourth ends are fixed to the circular base along the outer circumference.

21. The system of claim 16, wherein the equipment comprises a Christmas tree, a blowout preventer (BOP) stack, a valve assembly, a compressor, an oilfield production assembly, or any combination thereof.

22. The system of claim 16, wherein the first latching member generally curves between the first and second ends, the first latching member terminates and fixedly couples to the base at the first and second ends, the second latching member generally curves between the third and fourth ends, and the second latching member terminates and fixedly couples to the base at the third and fourth ends.

23. A safety-harness attachment comprising:

a base portion;

a first curved latching portion that generally curves between a first end and a second end, wherein the first curved latching portion terminates and fixedly couples to the base portion at the first and second ends; and a second curved latching portion that generally curves between a third end and a fourth end, wherein the second curved latching portion terminates and fixedly couples to the base portion at the third and fourth ends, wherein the first, second, third, and fourth ends are welded to the base portion, wherein the first and second curved latching portions intersect and fixedly couple to one another at a welded joint.

24. The safety-harness attachment of claim 23, wherein the base portion is welded to a Christmas tree, a blowout preventer (BOP) stack, a valve assembly, a compressor, an oilfield production assembly, or any combination thereof.

* * * * *